United States Patent [19]

Velikoselsky et al.

[11] 4,266,680

[45] May 12, 1981

[54] FLOATING CRANE WITH LOAD RESLINGING DEVICE

[76] Inventors: Nikolai D. Velikoselsky, prospekt Gagarina, 15, kv. 29; Anatoly I. Smirnov, ulitsa Marshala Birjuzova, 17, kv. 40; Nikolai Y. Perets, ulitsa Menshikova, 17, kv. 25, all of Sevastopol; Sergei S. Vinogradov, prospekt Kutuzovsky, 26, kv. 246, Moscow; Viktor I. Podbeltsev, ulitsa B.Morskaya, 38, kv. 4; Pavel E. Lakhno, ulitsa Prutovtsev, 13, both of Sevastopol, all of U.S.S.R.

[21] Appl. No.: 19,661

[22] Filed: Mar. 12, 1979

[30] Foreign Application Priority Data

Mar. 16, 1978 [SU] U.S.S.R. ..... 2592272
Nov. 22, 1978 [SU] U.S.S.R. ..... 2688352

[51] Int. Cl.[3] ..... B66C 23/52

[52] U.S. Cl. ..... 212/193; 212/234; 294/78 R

[58] Field of Search ..... 212/3 R, 3 A, 40, 29, 212/193, 234; 414/140, 143; 294/78 R, 82 R, 83 R

[56] References Cited

FOREIGN PATENT DOCUMENTS 535205 11/1976 U.S.S.R. ..... 212/3 R
590179 1/1978 U.S.S.R. ..... 212/3 R

*Primary Examiner*—Robert G. Sheridan
*Attorney, Agent, or Firm*—Steinberg & Raskin

[57] ABSTRACT

A floating crane whose floating base mounts a load boom with a load-handling device and a suspended-load reslinging device, the latter comprising a catch so mounted on the floating base as to project over the board thereof while in the load reslinging position, and a tie member carrying at one of its ends its own load-handling device and being adapted to successively link to the load-handling device of the load boom and to the catch in the course of load reslinging procedure.

5 Claims, 6 Drawing Figures

FLOATING CRANE WITH LOAD RESLINGING DEVICE

The present invention relates generally to materials handling equipment and has particular reference to floating cranes.

The floating crane provided according to the present invention is most advantageously applicable for carrying out hydraulic-engineering work in sea-water areas, or when outfitting the heads of the shelf-seated oil wells.

One prior-art crane is known to comprise a floating base carrying a turntable, whereon a load boom with a load-handling device is mounted, and a device for load reslinging while suspended. The latter device comprises a boom fixed stationary on the floating base and provided with a pulley tackle around which a steel-wire rope is reeved, the ends of the rope being detachably fixed one at the boom foot, and the other at the boom end.

For lowering the load into water by reslinging it in a suspended state the ends of the rope are successively connected to the load handling device of the load boom.

The afore-described crane can be applied for carrying out hydraulic-engineering work at relatively shallow depths which is determined by and restricted to lifting height of the load-handling device of the load boom above water level.

Provision of a stationary fixed boom on the floating base incumbers and ties up the working zone of the load boom, as well as adds to the sail effect of the crane superstructure. In addition, to connect the wire rope of the pulley tackle with the load-handling device of the load boom on the end of the stationary boom is a dangerous and labour-consuming operation.

It is a primary object of the present invention to provide a floating crane, wherein the device for load reslinging in a suspended state would be of such a constructional arrangement that would make it possible to carry out hydraulic-engineering work at relatively deep depths.

It is another object of the present invention to reduce the sail effect of the floating crane in question as compared to known floating cranes.

It is one more object of the present invention to provide safety in attendance of the device for load reslinging in a suspended state in the course of operation thereof.

It is a still further object of the present invention to extend the working zone of the load boom.

In keeping with said and other objects proposed herein is a floating crane on a floating base of which are mounted a load boom with a load-handling device and a device for reslinging the load while suspended according to the invention the device for reslinging the load while suspended comprises a catch so mounted on the floating base to project over the board of the floating base in the course of load reslinging, and a tie member which carries at a vacant end thereof a load handling device and is adapted to be successively linked to the load-handling device of the load boom and to the catch in the course of load reslinging.

It is expedient that a bracket be made fast on the floating base, and that the catch be hinged to said bracket.

Such an installation of the catch enables it, while in travelling position, to be swivelled so as not to protrude beyond the outline dimensions of the floating base.

It is not less expedient that the tie member be built up by a plurality of links connected in succession in the course of load reslinging procedures, said links carrying at one of their ends load-handling devices which are in fact hooks, and that the catch be shaped as a horn curved upwards, whereas each of the links would have two eyes arranged one above the other and adapted for joining with the hook of a next link and with the horn of the catch.

Such an embodiment of said device is most simple from a constructional viewpoint and enables load of a comparably large mass to be lowered to a practically unlimited depth.

It is likewise expedient that the tie member be made as a chain and the catch would incorporate a body split for the chain to engage therein and incorporating a means for the chain to stop.

It is equally expedient that the chain be long enough to allow a multifold load reslinging while suspended and that said chain be connected to the load-handling device of the load boom through a stopper and a chain guide roller.

Such an embodiment of the tie member enables one to cut down time spent for load reslinging, i.e., to increase the productivity of the crane under consideration.

The floating crane implemented according to the present invention is capable of lowering loads to and lifting from practically unlimited depths when carrying out hydraulic-engineering and ship-raising operations, or outfitting the heads of sea-bottom oil wells. In addition, said crane features maximum possible working zone of the load boom.

Given below is a description of a specific embodiment of the present invention presented by way of illustration with reference to the accompanying drawings, wherein.

Figure 2:
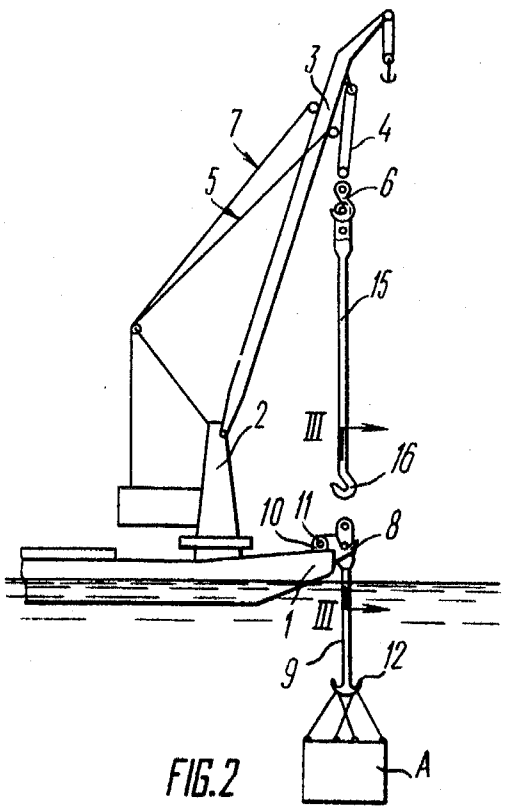
FIG. 2 is a view of FIG. 1 showing the link of the tie member carrying load suspended therefrom when connected to the catch.
Figure 1:
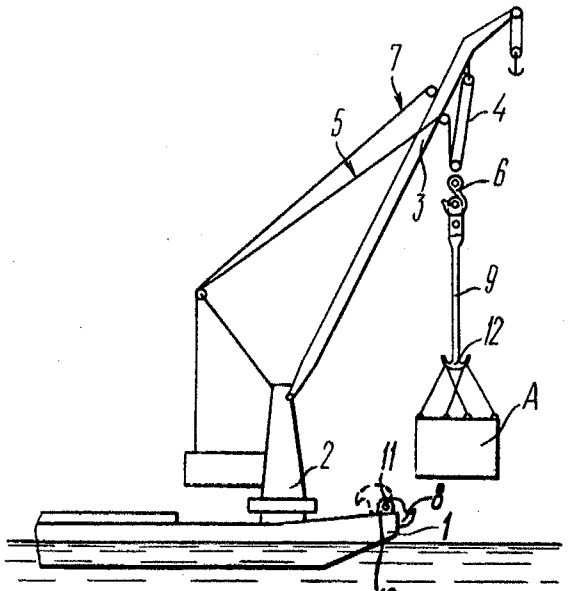
FIG. 1 is a schematic side view of a floating crane, according to the invention.
Figure 3:
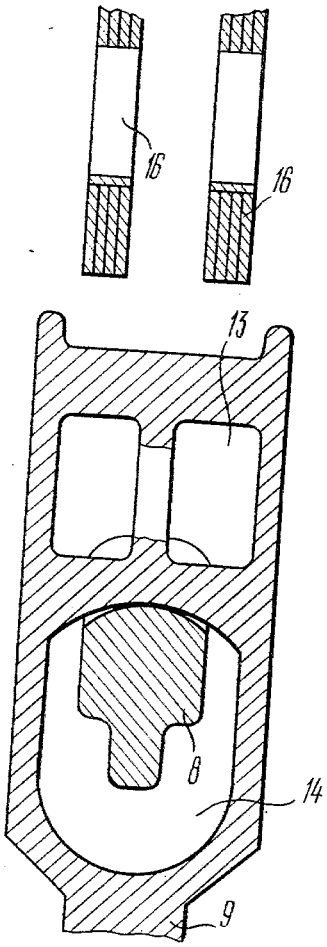
FIG. 3 is a scaled-up view of a section taken along the line III—III in FIG. 2.

Reference being now directed to FIGS. 1 and 2, the floating crane of the present invention comprises a floating base 1, whereon a turntable 2 is mounted, which carries a load boom 3. A load-handling device 6 is suspended from the load boom 3 through a pulley tackle 4 with a steel-wire rope 5 reeved therearound, said load-handling device being fashioned in the herein-considered specific embodiment of the invention, as a hook designated 6. Rope 7 is provided for the boom luffing.

The floating crane proposed herein has a device for reslinging a load "A" in a suspended state, said device comprising a catch 8 and a tie member 9 which is adapted to be linked successively to the hook 6 and the catch 8 in the course of load reslinging procedure. A bracket 10 is made fast on the floating base 1, wherein the catch 8 is hinge-mounted through a hinge pin 11, said catch being shaped as a horn curved upwards. The catch 8 is so mounted on the floating base as to project overboard while in working position, whereas while in travelling position the catch is arranged on the floating base 1 as shown with a dotted line in FIG. 1.

When lowering the load "A" to a relatively shallow depth the tie member 9 has a single link 9 and carrying at its vacant end a load-handling device 12 which is essentially a ramshorn hook 12. The other end of the tie-member 9 through which the latter is joined with the hook 6, is provided with two eyes 13 and 14 located one above the other, the eye 13 serving to connect the tie member 9 to the hook 6, and the eye 14, to connect the tie-member 9 to the catch 8.

When lowering the load "A" to a deep depth the tie-member is built up by a plurality of links 9 and 15 (FIG. 2). The link 15 is similar to the link 9 with the sole exception that the vacant end of the link 15 is shaped as two parallel single hooks 16 adapted to be joined with the eye 13 of the tie-member 9.

Figure 4:
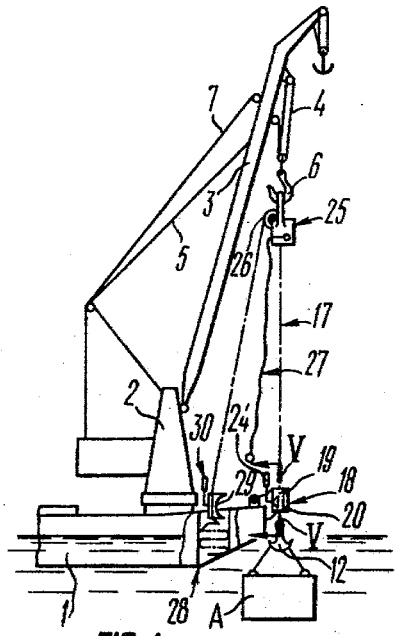
FIG. 4 shows the floating crane in the position where the anchor chain passes through the catch.

In another embodiment of the device for reslinging the load "A" in a suspended state the tie member is made as an anchor chain 17 (FIG. 4) which carries, at the vacant end thereof, its own load-handling device, viz., the ramshorn hook 12, whereas catch 18 comprises a body 19 with a cover 20. The body 19 has a through hole for the anchor chain 17 to pass and accommodates a means 21 for the chain to stop, said means incorporating two oppositely arranged pawls 22 interconnected through a linkage 23. One of the arms of the linkage 23 is coupled to a lever 24 for control of the pawls 22.

Figure 6:
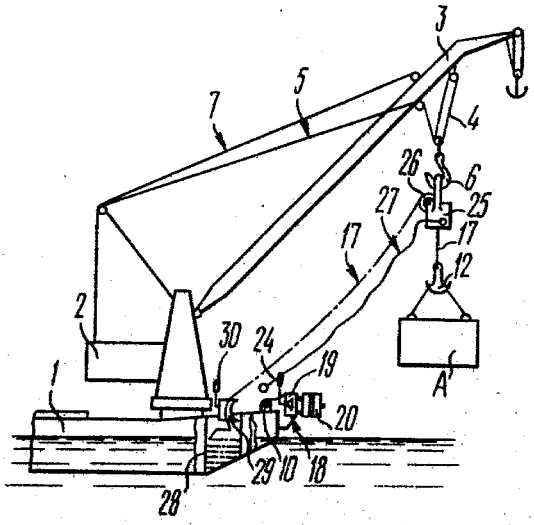
FIG. 6 is a schematic side view of the floating crane, wherein use is made of an anchor chain as the tie member of the load reslinging device.
Figure 5:
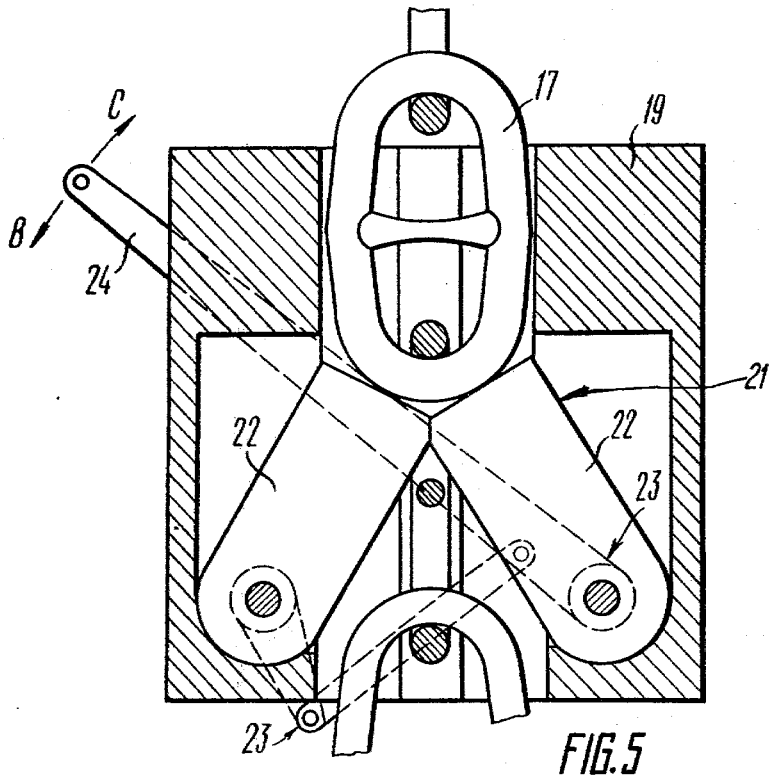
FIG. 5 is a scaled-up view of a section taken along the line V—V in FIG. 4.

The anchor chain 17 is connected to the hook 6 of the load boom 3 through a stopper 25 (FIGS. 4, 6) with a guide roller 26 through which the chain 17 is passed. The stopper 25 is similar in construction to the catch 18. The control lever 24 of the pawls is connected to a wire rope 27 for remote control of said pawls.

The anchor chain 17 is stowed in a locker 28 and is passed through a throat 29 which is also provided with a means 30 for the chain 17 to stop.

The afore-mentioned means for chain stopping may be of any arbitrary construction known in the art and suitable for the purpose.

The floating crane of the present invention operates as follows.

The catch 8 hinged in the bracket 10 is set to working position with the help of, say, the auxiliary raise pulley tackle of the load boom 3. Then the turntable 2 is swivelled so as to position the boom 3 over the stowage place of the links of the tie member 9.

Then the links of the tie member 9 stowed on the deck of the floating base 1 are joined with the load-handling device 6 of the load boom 3 by putting the hook 6 into the eye 13 and raised by means of the tackle block 4. Next the turntable 2 is swivelled so as position the link 9 over the load "A" and the latter is connected to the hook 12 through the rope slings, whereupon the load "A" is lifted using the pulley tackle 4 through heaving up the rope 5. The load lifting mechanism (not shown) is then disengaged, and the turntable 2 is swivelled to bring the load boom 3 to the same plane with the catch 8. This done the load lowering mechanism is engaged, and the load "A" is let to descend under water by easing out the rope 5 of the pulley tackle 4. As soon as the eye 14 approximates the level at which the horn of the catch 8 is located, the luffing mechanism (not shown) of the boom 3 is engaged and, while heaving up the wire rope 7, the outreach of the load boom 3 is reduced, whereupon the link 9 is hung on the horn of the catch 8 by the eye 14 and the luffing mechanism of the boom 3 is disengaged. As the ropes 5 of the pulley tackle 4 get slackened the load lowering mechanism is disengaged.

Thus, the load "A" is suspended from the catch 8 through the link 9. Thereupon the luffing mechanism of the boom 3 is engaged again to bring the hook 6 out from the eye 13 of the link 9.

To lower the load "A" to a still deeper depth, the link 15 is hung on the hook 6 of the boom 3 by the eye 13, and the boom 3 is set in the same plane with the catch 8. This done the boom luffing mechanism is engaged to reduce the boom outreach, while the load lowering mechanism is engaged to bring the hook 16 of the link 15 to the eye 13 of the tie member 9. Next the load lowering and boom luffing mechanisms are disengaged. As a result, the load is suspended by the link 9 which, in turn, is suspended from the catch 8 and connected to the link 15 coupled in its turn to the hook 6.

Then the load lifting mechanism is engaged and, while increasing the boom outreach, the eye 14 of the link 9 is released from the horn of the catch 8. Next the load lifting mechanism and the luffing mechanism of the boom 3 are disengaged, and the load lowering mechanism of the boom 3 is engaged; then the load "A" is let to descend to a still deeper depth by easing out the rope 5 of the pulley tackle 4.

The above-described operations of extending the tie member 9 by the links 15 are repeated to suit a required load descending depth.

The load is raised from under water by successively disconnecting the links 15 from the tie member 9 through reversing the sequence of procedures and manipulations with the boom 3.

The above-disclosed device for load reslinging in a suspended state is reasonable to be applied for lowering loads exceeding 400 tons.

In the case where the anchor chain 17 is made use of as the tie member the herein-proposed crane operates as follows.

The catch 18 hinged in the bracket 10 is set to working position with the use of the auxiliary raise pulley tackle of the load boom 3.

The chain stopper 25 with the chain 17 passing therethrough is connected to the hook 6 of the boom 3, and the chain 17 is stopped therein by turning the lever 24 in the direction facing "B"; while so doing a length of the chain 17 shall be left between the stopper 25 and the hook 12.

Next the load lifting mechanism is engaged, the stopper 25 and the hook 12 are raised all the way and the load lifting mechanism is disengaged. Then the chain 17 is stopped in the throat 29 of the chain locker 28 by means of the stopper means 30, and the luffing mechanism of the boom 3 is engaged to set the hook 12 over the load "A", whereupon the luffing mechanism is disengaged. The load "A" is joined to the hook 12 through the rope slings, whereupon the load lifting mechanism, the luffing mechanism of the boom 3 and the swivelling mechanism of the turntable 2 are engaged for the load "A" first to lift, then lower at the required spot. Once the length of the chain 17 has reached the level at which the catch 18 is located, the load lowering mechanism of the load boom 3 is disengaged, the cover 20 of the body 19 is opened, the length of the chain 17 is brought into the body 19 and the cover 20 is closed. Thereafter the chain 17 is stopped in the catch 18 by means of the stopper means 21, for which purpose the lever 24 is turned towards the arrow "B". Then the load lowering mechanism of the boom 3 is engaged, and the chain 17 with the load "A" is suspended from the catch 18.

Next the chain 17 is released in the stopper 25 by turning the lever 24 towards the arrow "C", the load lifting mechanism is engaged and the stopper 25 is lifted all the way up; while so doing the chain 17 is released in the throat 29. At the same time the chain is being paid out from the locker 28 while rolling over the roller 26 of the stopper 25. As the stopper 25 approaches the topmost position it gets engaged by turning the lever 24 remotely through the rope 27 in the direction facing "B", thereby releasing the load "A" from the catch 18. Then the chain 17 is released by the stopper means 21 in a way similar to that described above and, while easing out the rope 5 of the pulley tackle 4, the load "A" is lowered to a required depth, by passing the chain 17 through the body 19 as through a hawsehole.

To effect multiple reslinging operations, manipulations with the stopper 25 and the stopping means 21 are repeated many times. In order to raise the load from under water, the afore-specified operations are carried out in a reversed order. The above-described device for load reslinging is expedient to be used for lowering a load not in excess of 400 tons.

What is claimed is:

1. In floating crane apparatus including a floating base on which are mounted a load boom; a load-handling device suspended from said load boom; means for luffing said boom; means for lifting the load suspended from said load-handling device; the improvement comprising a device for reslinging a suspended load, including: a catch mounted on said floating base so as to project overboard of said floating base in the course of load reslinging procedure; an elongate tie member; a load-handling device provided on one of the ends of said tie member; and means provided on the other end of said tie member for successively linking said tie member to said load-handling device of said load boom and to said catch in the course of a load reslinging procedure.

2. A floating crane as claimed in claim 1, wherein a bracket is fixedly mounted on the floating base thereof, and the catch is hinge-mounted on said bracket, whereby said catch can be pivoted between an operating position wherein it projects overboard of said floating base and a stored position wherein the same does not project overboard of said floating base.

3. A floating crane as claimed in claim 1, wherein the tie member comprises a plurality of elongate, rigid links adapted to be mutually connected in end-to-end fashion in succession in the course of a load reslinging procedure, said links being provided at one of their ends with hook-like load-handling devices and wherein the catch is shaped as an upwardly curved horn, and wherein each of the links is provided at the other of its ends with means for defining two eyes arranged one above the other, said eyes comprising means for alternatively coupling a respective link to the hook-like device of another link and, alternatively, to the horn of the catch.

4. A floating crane as claimed in claim 1, wherein the tie member comprises a chain, and wherein the catch comprises a split body in which the chain is received for engagement, and further including within said body means for engaging the chain to prevent any movement of the chain through the body.

5. A floating crane as claimed in claim 4, wherein the chain has a length sufficient to allow a multifold reslinging of a suspended load, said chain being connected to the load-handling device of the load boom through stopper means having a chain guide roller associated therewith.

* * * * *